United States Patent [19]

Fahlström et al.

[11] 4,060,464

[45] Nov. 29, 1977

[54] METHOD FOR EXTRACTING AND RECOVERING IRON AND NICKEL IN METALLIC FORM

[75] Inventors: Per Anders Herman Henningsson Fahlström, Akers Runo; Thomas Konrad Miöen, Stockholm; Gotthard E. Björling, Djursholm, all of Sweden

[73] Assignee: Boliden Aktiebolag, Stockholm, Sweden

[21] Appl. No.: 706,485

[22] Filed: July 19, 1976

Related U.S. Application Data

[63] Continuation of Ser. No. 585,669, June 10, 1975, abandoned.

[30] Foreign Application Priority Data

June 26, 1974 Sweden ..... 7408394

[51] Int. Cl.[2] ..... C25C 1/06; C25C 1/08; C25C 1/24

[52] U.S. Cl. ..... 204/113; 204/123

[58] Field of Search ..... 204/123, 113

[56] References Cited

U.S. PATENT DOCUMENTS

| | | | |
|---|---|---|---|
| 1,980,381 | 11/1934 | Cain | 204/113 |
| 3,766,026 | 10/1973 | Kruesi | 204/113 |

OTHER PUBLICATIONS

Electrodeposition of Alloys, Abner Brenner, vol. II, 1963, pp. 250–251, 267–268.

*Primary Examiner*—T. M. Tufariello
*Attorney, Agent, or Firm*—Stevens, Davis, Miller & Mosher

[57] ABSTRACT

A method of extracting iron and nickel from sulphidic iron-nickel-materials and recover them in metallic form. The method comprises leaching the material with an acidic solution in presence of an oxidizing agent, so that substantially the whole quantity of the oxidizing agent is consumed. The obtained leaching liquid is then divided into two parts and one part is led to the cathode chamber, where iron and nickel is co-electro deposited and the other part is led to the anode chamber were the leaching liquid is regenerated before reuse.

17 Claims, 1 Drawing Figure

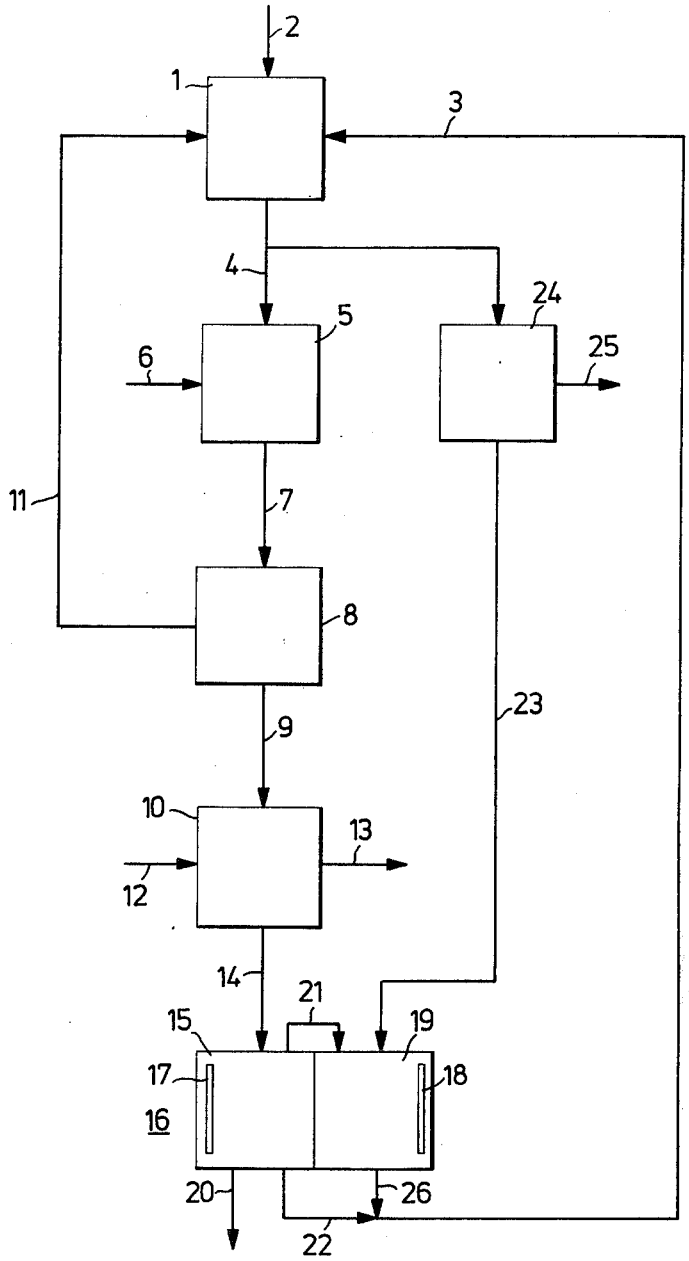
2
1
3
4
5
24
6
25
11
7
8
23
9
10
13
12
14
21
15
19
17
18
16
20
26
22

METHOD FOR EXTRACTING AND RECOVERING IRON AND NICKEL IN METALLIC FORM

This is a continuation of application Ser. No. 585,669 filed June 10, 1975, now abandoned.

The present invention refers to a method of extracting in metallic form the iron and nickel content of sulphidic iron-nickel-materials by leaching with an acid solution containing an oxidizing agent and by electrolytic co-deposition of leached nickel and iron.

The extraction of nickel from available sulphidic raw material is at present done in a variety of ways most of which aim at the recovery of nickel in the metallic or oxidic state.

Nickel is normally extracted from nickel ores of which pentlandite is the most important. Pentlandite is an iron-nickel-sulphide which is usually present together with chalco-pyrite ($CuFeS_2$) and pyrrotite (FeS). Copper-nickel matter, an intermediate product of a pyrometallurgical process containing FeS, $Ni_3S_2$, and also possibly $Cu_2S$, can also be considered as a nickel raw material. The nickel raw materials mentioned often also contain cobalt and noble metals such as platinum and palladium.

In extracting nickel from the above mentioned raw materials both pyrometallurgical and hydrometallurgical methods are employed. Hydro-metallurgical methods in particular have attracted increasing interest because of the difficulties of avoiding contamination of the environment and the fact that the pyrometallurgical methods presently available are complicated and costly. Hydrometallurgical methods have the added advantage that sulphur in elementary form is obtained.

Pyrometallurgical methods normally consist of a first step in which a matte is produced by smelting the raw material, possibly preceded by a roasting process. Some of the sulphur thereby disappears as $SO_2$ and some of the iron content and gangues of the material as slag. Remaining iron and sulphur are left in the coarse metal together with the entire nickel, copper and noble metal content. A typical nickel-copper matte can contain approx. 50% Ni, 25% Cu, 24% S, 1% Fe and minor quantities of noble metals.

One way of working up the matte is to subject it to a pyrometallurgical process usually in combination with a final electrolysis in which metallic nickel is precipitated on the cathode. The matte, however, can also be treated entirely by a hydrometallurgical process. The matte can, for example, be leached with sulphuric acid whereby copper remains in the residue. Iron can be precipitated as hydroxide from a nickel sulphate solution and nickel is obtained at the cathode after electrolysis. See for example Seeste, Harkki, "Das Outokumpu Schwebesmelzverfahren fuer Nickelkoncentrat" (Symposium Nickel, Wiesbaden, 1970). Both autoklave leaching and leaching at atmospheric pressure are applied in such methods. (CIM Bulletin page 74–81, 67; 2 (1974) ).

The Canadian company, Falconbridge, has developed a method which has been tested on a pilot plant scale whereby both the matte and the pyrrhotite containing nickel are leached with hydro-chloric acid. Copper remains in the leach residue and sulphur forms hydrogen sulphide which can later be oxidized to elementary sulphur. The iron and nickel content of the material exist as chlorides in solution. After separation by liquid-liquid extraction the nickel chloride is crystallized out. This can subsequently be worked up to nickel oxide or metal. (J. Metal pp 13–18, 23; 7 (1971) CIM Bulletin pp 97–103, 67; 2 (1974) ).

Only purely hydrometallurgical method of working up sulphidic nickel concentrates exist at present on a commercial scale, namely, a method after Sherritt Gordon. Oxidization leaching with ammonium hydroxide under pressure takes place whereby nickel, copper, cobalt and sulphur go into solution, the last as ammonium sulphate. The iron remains in the residue while copper and cobalt are precipitated as sulphides. Nickel is precipitated as metallic powder by reduction under pressure with hydrogen gas. (See Ullmanns Encyklopaedie der technischen Chemie, volume 12, page 705 (1960) ).

Sulphuric acid, hydrochloric acid and ammonium hydroxide have been mentioned above as leaching agents in the leaching of concentrates, matte or other material containing nickel sulphide. The use of iron chloride, copper chloride and nitric acid have also been suggested. However, development work has here been directed towards treating copper concentrates or iron pyrites rather than towards material containing nickel. Rio Tinto one time used the Dotsch-process in this way, i.e. the leaching of copper sulphides with ferric chloride (Tafel; Lehrbuch der Metallhuettenkunde, volume 1, 5510 (1951) ). The Hopfner-process, i.e. leaching with copper chloride, has also been applied on a large scale. (German Pat. No. 53 782). During the 1950-s Erich Konrad developed and suggested a process of leaching pyrites with ferric chloride but it is uncertain if it was ever applied on an operational scale. (Chem. Engn. pp 189–192 April (1953) ).

Cyprus Metallurgical Processes Corp., Los Angeles, USA have patented a method where sulphide concentrates are leached with iron(III)chloride (U.S. Pat. No. 3,766,026). A pilot plant for leaching copper sulphide concentrate is reported to have been opened recently. Norddeutsche Affinierie have applied for patents on a process where concentrates, intermediate products and the like are leached with iron(III)ions, in particular solutions iron(III)-sulphate (DTOS No. 2,030,503).

After leaching, regeneration of the leaching agent is attempted so as to reduce both costs and the volume of effluents. Sulphuric acid, for example, can be regenerated by electrolysis with lead anodes. Hydrochloric acid can be regenerated by hydrolysis of iron chloride. Iron(III)ions can be reformed by oxidizing iron(II)ions formed in the leaching with, for example, air or oxygen (DTOS No. 2,030,503) or by anodic oxidization in electrolysis (Konrad, Chem. Eng. p 189 (1953) and U.S. Pat. No. 3,766,026), or by oxidation with chlorine (DTOS No. 2,206,343).

Since the leaching efficiency of one-step leaching is low several steps must be used. Even if leaching takes place under pressure in an autoclave leaching efficiency is still insufficient. There are in general considerable technical difficulties in carrying out leaching of this type. For example, U.S. Pat. No. 3,766,026 (Cyprus) suggests a final leaching step in the anode chamber of an electrolysis cell fitted with a diaphragm in which copper is electrodeposited on at the cathode.

The nickel content of the basic material is worked up and sold, normally as nickel oxide or metallic nickel. In the latter case nickel powder can be obtained by reducing for example, ammoniacal nickel sulphate solutions with hydrogen gas at pressure or nickel cathodes can also be produced in the known way by electrolysis of a nickel chloride or nickel sulphate solutions. Cathodic electrodes position of alloys containing nickel takes place in the galvanizing industry but in this case it is not metal production that is concerned but a surface treatment in which a thin layer of alloy is deposited as protection against corrosion or wear.

The sulphur content of the basic material can be recovered as a sulphur dioxide, sulphurtrioxide, sulphuric acid, elementary sulphur ammonium sulphate or gypsum. If sulphuric acid or liquid sulphur dioxide are to be produced it is essential that the concentration of the sulphur dioxide gas formed is sufficiently high if production is to be economic. The alternative of extracting sulphur in the form of elementary sulphur can for reasons of environmental consideration be regarded as extremely attractive and the sulphur so obtained can easily be stored, sold or refined further. To a limited extent a use can be found for ammonium sulphate as fertilizer. If obliged to neutralize the sulphuric acid with lime the gypsum so obtained can only be disposed of in minor quantities. A similar situation applies if ammonium sulphate cannot be disposed of and must be treated with lime instead.

The iron content of the basic material is most often transformed to iron hydroxide of little economic value. Attempts have been made to prepare the iron precipitation in a relatively pure form which after calcination can be sold to the steel industry as a sort of raw material but this is normally hampered by the much too large content of undesirable metals and sulphur. Heavy metals such as copper, zinc and nickel are precipitated together with or easily adsorbed on the iron precipitation formed. Another way of extracting iron is possible if the iron in any of the process steps consists of pure iron chloride so that the chloride can be hydrolysed to iron oxide and hydrochloric acid. It is here difficult to extract the iron oxide in a form sufficiently free of chlorides etc. So that it can be disposed of as iron raw material. Yet another method of collecting the iron content of the basic material is the electrolytic preparation of iron. The electrolytic preparation of iron in connection with working up of pyrites has been suggested by Konrad (see above) and in connection with the working up of scrap alloys by Aue et al. (Sw No. 345,967). Cyprus Metallurgical Processes Corp., Los Angeles, USA show in their process proposal for working up copper concentrate (U.S. Pat. No. 3,766,026) the use of an extra electrolysis circuit (apart from the copper electrolysis circuit) in which the iron content of the concentrate is extracted as electrolytic iron.

The copper content of the basic material is very often of considerable economic value. It is therefore desirable that the copper is extracted as a marketable by-product. Generally known techniques have been worked out for extracting copper from leaching solutions by means of cementing or electrolysis.

There does exist a need for a working-up process of metallic sulphides where the entire metallic content of the basic material can be extracted. Because of environmental considerations such a process ought to be hydrometallurgical and consist of, apart from the products, a closed circuit without the production of waste and lead to the formation of elementary sulphur. For reasons of economy leaching ought to be carried out at atmospheric pressure in conventional leaching equipment and the leaching agent must easily be regenerated.

It has now surprisingly been shown possible to extract iron and nickel in metallic form from sulphidic iron nickel materials such as pentlandite and copper nickel matte. The method is characterized in that the material is leached with an acidic solution containing an oxidizing agent comprising trivalent iron. The leaching liquid is transferred after leaching to the cathode chamber of an electrolytic cell with separated cathode and anode where an electrolytic co-deposition of iron and nickel takes place. In the anode chamber the oxidizing agent is regenerated after which the leaching liquid is returned to the leaching process.

After leaching in the first leaching step the leaching liquid is divided into two parts. One part is led after purification of the solution through, for example, a second leaching step to the cathode chamber and the other part to the anode chamber. The leaching liquid partially impoverished by the electrolysis of nickel and iron is returned from the cathode chamber to the leaching process or is transferred to the anode chamber for regeneration.

The leaching liquid which is led to the cathode chamber ought not to contain copper or oxidizing agent. A suitable method of removing the oxidizing agent and part of the constituent copper is to pass the liquid to a second leaching step with a great excess of leachable material. Copper can be completely removed by means of cementating electrolysis, liquid-liquid extraction or by selective sulphide precipitation by methods already known.

Iron(III)ions are the oxidizing agent in the leaching process. Copper(II)ions can be used together with the iron (III) ions. The cations mentioned are found in the leaching liquid together with anions such as halogenide ions, principally chloride ions. The presence of copper-ions is not absolutely essential in the leaching process but up to 20 g Cu per liter has been shown to have a surprisingly catalytic effect on the leaching process. In the steady state the leaching liquid will contain ions of iron, nickel, copper and sodium besides chloride ions. The presence of sodium ions is caused by the fact that copper(I)-chloride and other metal chlorides are of low solubility and must be transferred in soluble complexes by means of, for example, chloride ions which are introduced into the system in the form of sodium chloride.

Naturally, it is possible to use other soluble chlorides such as other alkali chlorides, alkali earth chlorides, for example, potassium chloride and calcium chloride. The use of calcium chloride has the advantage that any sulphate formed thereby is precipitated as gypsum. If the raw material contains lead, sulphate ions can be deliberately added to give a precipitation of lead sulphate. In the leaching of iron-nickel concentrates a leaching solution with a pH-value of 0.5 can contain

| Interval | Principally |
|---|---|
| 10–70 | 50 g Fe/l |
| 0–30 | 20 g Cu/l |
| 5–30 | 15 g Ni/l |
| 50–150 | 80 g NaCl/l |

The temperature of leaching process ought to be as high as possible, normally between 90°–110° C but below the boiling point of the solution. It is desirable to work at atmospheric pressure which, with the leaching solution stated above, requires a temperature of approx. 105° C. For finely divided concentrates the requisite leaching time is approx. 2 hours in the first step.

In the second leaching step the pH-value rises to approx. 3 and the leaching temperature is held at 70°–105° C preferably at approx. 80° C. The purpose of this step is to remove excessive oxidizing agent by the presence of an excess of concentrate and also by bringing the copper content of the solution into contact with fresh concentrate partially precipitate this copper so that the solution emerging from this leaching step contains as much copper as corresponds to the leaching residue removed. This precipitated copper which is highly soluble is returned with the leaching residue to the first leaching step.

Sulphidic iron-nickel-material such as pentlandite or similar minerals or copper-nickel matte are used as basic material. The material has normally been concentrated by flotation and is thus finely divided. The material normally contains sufficient quantities of copper to meet by means of the measures just mentioned the requisite level of copper in the first leaching step. If it does not, copper ought to be added. The finished leached residue will contain most of concentrate sulphur in the form of elementary sulphur as well as noble metals and gangues included.

Electrolysis is carried out in a cell with separated anode and cathode chambers. These are separated by a diaphragm which can be permeable or impermeable to metal ions. An inert anode of, for example, graphite where iron(II)-ions are oxidized to iron(III)-ions can usefully be placed in the anode chamber. Measures must be taken to ensure that the flow of liquid into the anode chamber is sufficiently high to maintain an effective quantity of oxidizable material at the anode.

The cathode chamber can be designed in different ways depending on whether it is desired to have the iron-nickel electro deposition in the form of a coherent deposit on the cathode or as a precipitated mass which can easily be scraped from the surface of the cathode. If a coherent thick cathode deposit is desired the cathode ought to consist of a thin plate of iron, steel or an iron-nickel alloy. If a scrapable precipitation is required a thicker plate is used together with devices for continual scraping. The cathode can also with advantage be treated with release agent such as crude oil, diesel oil or the like. The character of the precipitation can be governed by varying the intensity of current and by additive such as colloids.

The chemical composition of the cathode deposit is governed principally by the composition of the catholyte but also by the intensity of current used. For commercial reasons a nickel content of at least 15% nickel in the electro deposited cathode alloy is desirable. To reach this level a minimum nickel/iron-ratio of approximately 1:2 in the catholyte is required since iron is deposited first so that the iron/nickel-ratio in the cathode metal is approximately one third of the corresponding ratio in the catholyte. If the composition of the concentration is such that the desired ratio of nickel/iron in the catholyte cannot be maintained a richer nickel material must be added to the leaching process as compensation. Further nickel can be added in the cementation of copper or in the form of an nickel-salt solution to the catholyte.

The invention will now be described with reference to one possible method and the accompanying FIGURE.

The FIGURE shows a flow diagram of a possible application according to the invention where a sulphide material contain iron-nickel is led into the first leaching step 1 via a feeding device 2 and where regenerated leaching liquid is led through a conduit 3. A part of the leaching liquid and the concentrate slurry contained in it are removed via a conduit 4 and led to a second leaching step 5. To the leaching step 5 is also led concentrate via a conduit 6 by the fact that concentrate is present in excess. In the second leaching step 5 remaining oxidizing agent in the leaching liquid on the first leaching step is consumed. Via a conduit 7 is led leaching liquid and the slurried material in it are led to a separation step 8 from which leaching liquid via a conduit 9 is led further to a cementation tank 10. The material separated from the leaching liquid in the separation step 8 is led by means of a conveyor 11 back to the first leaching step 1. Scrap iron or other suitable agent for cementing copper such as nickel powder and iron powder are led via a feeding device 12 to the cementation tank 10. From the cementation tank 10 cemented copper and unused cementation agent are transported by means of a conveyor device 13. The leaching liquid now free of copper is led by means of a conduit 14 to a cathode chamber 15 in an electrolytic cell 16 fitted with a diaphragm. The electrolytic cell 16 has a cathode 17 in the cathode chamber 15 and an anode 18 in the anode chamber 19. The anode 18 and the cathode 17 are provided with electric current by means of a circuit not shown in the diagram. In the cathode chamber 15 an alloy of iron and nickel is electro deposited on the cathode 17. This alloy can be collected by removing the cathode 17 if the alloy is electrod deposited on the cathode and via the conveyor device 20 if the alloy is deposited as an easily scrapable powder or the like. From the cathode chamber 15 the leaching liquid now impoverished of metals is led either via conduit 20 or through the diaphragm 27 to the anode chamber 19 or via conduct 22 back to the first leaching step 1. Leaching liquid from the first leaching step 1 is also led to the anode chamber 19 via a conduit 23. This conduit also contains a separation device 24 from which the final residue is removed by a conveyor device 25. The residue can be washed in a device not illustrated and the washing water can be returned to leaching step 1. In the anode chamber the iron(II)-content of the leaching liquid will be oxidized to iron(III)-ions which act as oxidizing agent in the leaching process. From the anode chamber the regenerated leaching liquid is led back to the first leaching step 1 via conduits 26 and 3.

EXAMPLE

A leaching tank of capacity 15 $m^3$ was continuously fed with 20 tons of nickel concentrate per 24 hours containing 12% Ni, 30% Fe, 26% S and 5.1% Cu and treated with an excess of leaching liquid containing a hydrochloric metal chloride solution containing 37.5 g Fe(III) per liter, 20 g Cu(II) per liter, 17.5 g Ni(II) per liter. After leaching, the leaching liquid contained 49 grams Fe(II+III) per liter and 19.5 g Ni per liter. Pulp was dispensed and divided into two parts, one of which was led to a second leaching step and used to leach fresh concentrate in excess after which the leaching liquid, after separation of residue contained 30 g Ni per liter, 50 g Fe(II) per liter and 6 g Cu per liter. The residue was returned to the first leaching tank. By means of cementation with iron powder the copper content of the leaching liquid was precipitated down to a content of less than 10 mg per liter. The leaching liquid was thereafter introduced into the cathode chamber in a diaphragm cell and an alloy of 25% Ni and 75% Fe was precipitated after which the leaching liquid contained 20 g Ni per liter and 20 g Fe(II) per liter. The electrolysis was carried out with a current intensity of 1500 A/m² at a temperature of approximately 60° C. Energy consumption in the electrolysis was 290 GJ per 24 hours. The leaching liquid was transferred after the electrolysis to the anode chamber to which at the same time was led the other part of the leaching liquid from the first step after separation of residue containing mainly gangues, elementary sulphur and minor quantities of noble metals present in the concentrate. In the anode chamber Fe(II) present in the leaching liquid was oxidized to Fe(III) after which the leaching liquid was returned to the first step.

We claim:

1. A method of extracting and recovering the iron and nickel content of sulphidic iron-nickel-materials in the form of an alloy comprising at least 15% by weight nickel comprising the steps of leaching the material with an acidic solution containing an oxidizing agent comprising trivalent iron, so that substantially the whole quantity of said oxidizing agent is consumed; leading a part of the leaching liquid obtained to the anode chamber of an electrolytic cell, which comprises separate cathode and anode chambers; regenerating in said anode chamber said oxidizing agent for re-use in the leaching step; leading the remaining part of said leaching liquid having a nickel/iron ratio of at least about 1:2 to the cathode chamber; co-electrodepositing the iron and nickel content in said leaching liquid on the cathode in said cathode chamber; separating the iron - nickel deposit obtained from said leaching liquid and returning said leaching liquid to the leaching step.

2. A method according to claim 1 wherein the leaching liquid subsequent to the electro deposition in the cathode chamber is transferred to the anode chamber where the oxidizing agent is regenerated whereafter the leaching liquid is returned to the leaching step.

3. A method according to claim 1 wherein the leaching process is carried out in two steps comprising leaching the sulphide materials in a first step with an excess of oxidizing agent; transferring at least part of the leaching liquid obtained to a second leaching step; contacting said part of said leaching liquid in said second leaching step with an excess of sulphidic material, whereby the oxidizing agent in said part is consumed and co-electro depositing at least partially the iron and nickel content of said part in the cathode chamber.

4. A method in accordance with claim 1, wherein the oxidizing agent used is in the form of a solution of iron-(III)chloride.

5. A method in accordance with claim 1, wherein any copper ion content present of that part of the leaching liquid which is led to the cathode chamber is firstly removed by cementating, liquid-liquid extraction or precipitation as a sulphide.

6. A method in accordance with claim 1, wherein the leaching liquid contains 0–20, g/l copper(II)ions.

7. A method in accordance with claim 1, wherein copper ions are added to the leaching liquid in a quantity sufficient to maintain the content at 10–20 g/l.

8. A method in accordance with claim 1, wherein chloride ions are added in a quantity sufficient to raise the content to 50–150 g/l.

9. A method in accordance with claim 9, wherein the chloride ions are added partially in the form of calcium chloride.

10. A method in accordance with claim 9, wherein the chloride ions are added partially in the form of sodium chloride.

11. A method in accordance with claim 1, wherein the temperature of the first leaching step is maintained at between 90° and 110° C.

12. A method in accordance with claim 3, wherein the temperature of the second leaching step is maintained at between 70° and 105° C.

13. A method in accordance with claim 1, wherein a concentrate of one or several iron-nickel-sulphide minerals, is used as basic material.

14. A method in accordance with claim 1, wherein crushed and ground copper-nickel matte is used as basic material.

15. A method according to claim 1 when the ratio between nickel and iron is lower in the sulphidic iron-nickel raw material than in the desired product wherein an additional material with higher nickel-iron ratio is introduced into the leaching process.

16. A method according to claim 1 when the ratio between nickel and iron is lower in the sulphidic iron-nickel raw material than in the desired product, wherein nickel is introduced in the leaching liquid led to the cathode chamber.

17. A method in accordance with claim 1, wherein any lead ion content present in the leaching liquid is recipitated as lead sulphate by adding sulphate ions to said liquid.

* * * * *